United States Patent [19]

Korach et al.

[11] 4,366,041

[45] Dec. 28, 1982

[54] METHOD OF PREPARING A CATHODE-DIAPHRAGM UNIT

[75] Inventors: Malcolm Korach, Pittsburgh, Pa.; Ronald D. Chamberlin, Wadsworth, Ohio

[73] Assignee: PPG Industries, Inc., Pittsburgh, Pa.

[21] Appl. No.: 235,454

[22] Filed: Feb. 18, 1981

[51] Int. Cl.[3] ..... C25B 9/00; C25B 11/03; C25B 13/06; C25B 13/08

[52] U.S. Cl. ..... 204/252; 204/283; 204/290 R; 204/295; 204/296

[58] Field of Search ..... 204/283, 284, 290 R, 204/252, 253-258

[56] References Cited

U.S. PATENT DOCUMENTS

| | | | |
|---|---|---|---|
| 3,711,382 | 1/1973 | Anthony | 204/1 R |
| 4,036,728 | 7/1977 | Babinsky | 204/283 |
| 4,112,149 | 9/1978 | Babinsky | 204/283 X |
| 4,154,666 | 5/1979 | Patil et al. | 204/283 |
| 4,175,023 | 11/1979 | Argade et al. | 204/283 X |
| 4,182,670 | 1/1980 | Argade et al. | 204/283 X |

OTHER PUBLICATIONS

Chemical Abstract 82:36701m; "Diaphragm Coated Cathode for Electrolytic Cells", Fenn et al.

Chemical Abstract 86:23597q; "Improved Membranes for Electrolytic Cells", Rucker et al.

*Primary Examiner*—Donald R. Valentine

*Attorney, Agent, or Firm*—Richard M. Goldman

[57] ABSTRACT

Disclosed is a method of cathode-diaphragm where the cathode is coated with a protective film, and thereafter a diaphragm is deposited thereon.

42 Claims, No Drawings

METHOD OF PREPARING A CATHODE-DIAPHRAGM UNIT

DESCRIPTION OF THE INVENTION

Chlor-alkali electrolytic diaphragm cells, i.e., for the electrolysis of alkali metal chloride brines such as sodium chloride or potassium chloride, have an anode and a cathode with a diaphragm therebetween, e.g., a deposited diaphragm. By a deposited diaphragm is meant a diaphragm of deposited fibers or a deposit of a plurality of types of fibers, resulting in a self-adherent, entangled mass. Heretofore, the self-adherent, entangled mass has been strongly adherent to the cathode.

The self-adherent, entangled mass diaphragms contemplated herein include asbestos diaphragms, resin-reinforced asbestos diaphragms, and thermally cured asbestos diaphragms. Further included are diaphragms of resin fibers alone, as well as diaphragms of various combinations of inorganic fibers and resinous materials. As used herein permeable diaphragms include both electrolyte permeable diaphragms, and electrolyte impermeable, ion permeable diaphragms. Deposited diaphragms have heretofore been applied directly to a cathode structure, and have been found to be strongly adherent thereto. While the adhesion of the diaphragm to the cathode structure provides structural strength to the diaphragm, the adhesion of the diaphragm to the metallic surface of the cathode structure results in a major portion of the cathodic reaction occurring on the back surface of a cathode, i.e, the surface of the cathode facing away from the diaphragm and the anode, rather than the surface of the cathode facing the diaphragm and anode. This results in a relatively high electrolyte voltage drop, the current following an indirect path from the diaphragm, through a high resistance electrolyte, around the cathode elements, e.g., the mesh or perforate or foraminous sheet or plate, to the back surface of the cathode.

Moreover, the strong adherence of the diaphragm materials to the active surface of the cathode is particularly disadvantageous when the cathode is a catalytic cathode having an adherent catalytic film, layer, or surface of an electrocatalytic material on an electroconductive substrate. For example, the catalytic surface may be a material different from the substrate, such as an iron, nickel, or copper substrate with a porous or high surface area film, such as a nickel film. The adhesion of the catalyst film to the substrate may be of limited strength, and may be further weakened during cell operation by some degree of undermining due to corrosive and erosive effects. Moreover, the adhesion of the catalyst film to the substrate may be further weakened by repeated cycles of diaphragm removal and renewal. Therefore, a portion of the catalytic film may be removed along with the diaphragm material during removal and renewal of the diaphragm.

It has now been found that if a film, layer, or coating of a protective material is directly deposited upon the cathode, i.e., the metallic surfaces of the cathode, and the porous, catalytic surfaces, if any, thereof, between the cathode and the diaphragm, there is provided a cathode-diaphragm unit in which the diaphragm material is not strongly adherent to the metallic surfaces and catalytic surfaces, if any, thereof, whereby the front surface of the cathode, that is, the surface facing the diaphragm and the anode, is substantially free of adherent diaphragm material, and not blocked thereby.

As contemplated herein the protective material is present on the cathode surface and in the pores of the cathode surface, but not within the perforations of the cathode, leaving the cathode perforations accessible to the flow of liquid therethrough. As used herein "perforations" are the open areas between structural elements of the cathode. That is, the perforations are the perforations of a perforated plate cathode, the perforations of a perforated sheet cathode, or the open areas between the individual meshes, strands, or drawn elements of a metal mesh or expanded metal mesh cathode, or cathode screen. As used herein, "pores" include surface imperfections, surface irregularities, microfractures, dislocations, crystal boundaries, active sites of surface reactions, and the like. Such pores are typically minute, i.e., of Angstrom to micron size, and are characteristic of catalytic surfaces, e.g., leached Raney nickel surfaces, platinum black surfaces, and the like.

In this way the diaphragm is subsequently firmly supported by the cathode structure, but is not strongly adherent to the cathode surface. Thereby, easier removal of spent diaphragms for diaphragm renewal is possible with relatively little undesired simultaneous removal of the cathodic electrocatalyst, if any. In this way removal of spent diaphragms is simplified, retention of catalytic surfaces is improved, and an effective cell voltage reduction of about 0.05 volt or more may be obtained.

Preferably, the protective material that is deposited on the cathode, i.e., within the pores thereof, but substantially not within the perforations thereof, whereby to be interposed between the cathode and diaphragm prior to deposition, consolidation and formation of the diaphragm, is resistant to removal during deposition, consolidation, and formation of the diaphragm, but is substantially removable thereafter, under conditions that do not adversely effect the performance of the diaphragm.

DETAILED DESCRIPTION OF THE INVENTION

Disclosed herein is a method of preparing a cathode-diaphragm unit where the diaphragm is a self-adherent, entangled fibrous mat, conforming to and supported by the cathode, substantially non-adherent to the metallic surface of the cathode, and removable from the cathode without significant or substantial damage to the cathode or cathodic electrocatalyst, and the cathode-diaphragm unit prepared by the method disclosed therein.

By a self-adherent, entangled fibrous mat or web is meant a mat of fibers of diaphragm material, which fibers adhere to one another. The fibers may adhere to one another after curing, heating or other treatment, in this way forming a cohesive structure. Alternatively, there may be present modifiers, such as resinous materials, inorganic cementitious materials, or the like.

By conforming to and supported by the cathode it is meant that the diaphragm is the same shape as the cathode, that is, that the diaphragm is finger shaped where the cathode is finger shaped, and that the diaphragm is a flat plane where the cathode is a flat plane, and that the diaphragm interpenetrates the perforations of the cathodes.

By a diaphragm that is substantially non-adherent to the metallic surfaces of the cathode or the catalytic surfaces thereof, and initially spaced from the cathode, it is meant that the fibers of the diaphragm material are not intimately entangled in the pores of the cathode surface, and that the surfaces of the individual cathode elements, that is, the individual strands of wire or mesh or the cathode plate, are wetted by or are capable of being wetted by electrolyte and not blinded by adherent diaphragm material, whereby electrolysis may take place on the front surfaces thereof. As herein contemplated, contact between the diaphragm and the catalytic cathode material is irregular point contact, with contact-free channels of 2 to 5 or mils in diameter. This irregular point contact, with contact-free channels, is likely due to compression and partial collapse of the diaphragm because of the pressure differential between the anolyte and catholyte chambers and swelling of the diaphragm material during electrolysis.

By the diaphragm being removable from the cathode without substantial damage to the catalyst material present on the cathode surface, is meant that the catalyst material or substantial amounts thereof are not removed from the cathode substrate during diaphragm removal and renewal.

The cathode, including the cathode substrate and catalytic surface is preferably foraminous, for example, a perforated sheet, perforated plate, mesh, expanded mesh or screen.

The cathode herein contemplated has an electroconductive substrate, which may, optionally, have a catalytic surface thereon. By an electroconductive substrate is meant a metal substrate, for example, iron, cobalt, nickel, copper, as well as admixtures and alloys thereof, or a carbonaceous substrate as a graphite substrate. Preferably the substrate is a metal substrate. In industrial exemplifications it is most commonly an iron or steel substrate.

The substrate may be a perforated plate, perforated sheet, or a mesh. When it is a mesh it may be expanded, calendared, or flattened, i.e., rolled. The substrate preferably has an open area of 20 to 80 percent, and most frequently an open area of 35 to about 65 percent. One particularly desirable cathode substrate is calendared iron mesh having from 4 to 8 mesh per inch in each direction, i.e., from 16 to 64 mesh per square inch, and from 35 to 65 percent open area. The substrate having approximately 40 percent open area, 6 mesh per linear inch, i.e., 36 openings per mesh, and fabricated of 0.067 inch diameter steel is industrially available.

By a catalytic surface it is meant that the surface material has a lower hydrogen overvoltage than the substrate. Preferably, the catalytic surface, when present, is a high surface area material, having a surface area of from about 20 square meters per gram to about 200 square meters per gram and the surface material is resistant to the effects of caustic soda in concentrations of 8 to 55 weight percent.

One particularly desirable catalytic surface area is provided by high surface area nickel, for example, as a codeposit of nickel and a sacrificial metal, with subsequent removal of the sacrificial metal. High surface area nickel coatings may be prepared by codeposits of nickel and aluminum, nickel and iron, nickel and zinc, or nickel and vanadium, with subsequent removal of the aluminum, iron, zinc or vanadium. Other catalytic surfaces may be prepared by codeposition of the catalytic metal and a sacrificial metal, and subsequent removal of the sacrificial metal. Typical catalytic metals include iron, cobalt, nickel, molybdenum, ruthenium, rhodium, palladium, osmium, iridium, platinum, and mixtures thereof. Sacrificial metals include aluminum, iron, zinc, vanadium, chromium and the like, the sacrificial metal being more reactive with concentrated acids or bases then the catalytic metal. The metals may be codeposited by electrodeposition, chemical deposition, flame spraying, plasma spraying, ion bombardment, coating or spraying of slurries or suspensions, thermal decomposition of organometallics, or even thermal diffusion of one metal into another as thermal diffusion of iron into nickel.

Alternatively, the catalytic coating may be prepared by sintering powders of only the catalytic metal, or by sintering powders of the catalytic metal and the sacrificial metal and leaching out the sacrificial metal.

The diaphragm herein contemplated rests upon and contacts the cathode, for example as a fibrous entanglement of non-woven, unoriented fibers. The diaphragm may be as a fibrous entanglement of asbestos, most commonly chrysotile asbestos, or a fibrous entanglement of asbestos and a thermoplastic material. The fibrous entangled diaphragm, includng electrolyte permeable diaphragms and electrolyte impermeable, ion-permeable diaphragms, may be formed in-situ so as to conform to the cathode, and in this way the fibers are rendered strongly adherent to the cathode. Diaphragms prepared in-situ have a limited service life, for example, from about 3 months to about 18 months, depending upon the presence or absence of reinforcing material.

According to the invention herein contemplated, a protective layer is applied to the cathode between the cathode and the diaphragm.

The protective material is resistant to complete removal during deposition of the diaphragm material, that is, the asbestos or the asbestos and resin, and during the formation of the entangled, fibrous diaphragm microstructure. In this way adhesion of the diaphragm material to the cathode catalyst is avoided without inhibiting adhesion of the diaphragm material to itself or to the protective material. Thereby there is provided a diaphragm with the fibers of diaphragm material adherent to each other as a substantially self-adherent mass of entangled fibers.

The diaphragm may be deposited atop the film of protective material and the cathode by drawing fibrous diaphragm material from the slurry thereof, e.g, a slurry of asbestos in water, or brine, or aqueous caustic soda, or aqueous cell liquor, or from a slurry of asbestos and thermoplastic resin in a solvent such as an organic solvent, e.g., an alcohol, or an inorganic solvent such as water, brine, aqueous sodium hydroxide, or aqueous cell liquor.

The cathodic protective material is applied to the cathode as a film. The film may be a wax. The cathodic protective material is preferably sparingly soluble in the slurry solvent at the temperatures at which the diaphragm material is drawn. By sparingly soluble in the solvent is meant that, when applied to the cathode, the protective material requires at least several hours to be solubilized or destroyed by the solvent whereby to cover or cover and penetrate the pores of the cathode during diaphragm deposition. That is, the sparingly soluble material remains on the cathode as a coating or film for the time required to draw the diaphragm materials onto the cathode but may thereafter be destroyed or solubilized whereby to expose the cathode catalyst to the catholyte liquor. Preferably, the film, e.g. a sparingly soluble wax, is from 0.1 to about 10 mils thick, although thicker or thinner films may be employed, it being recognized that the film is non-uniform.

By a wax, as the term is used herein, is meant a material having a waxy feel, a melting point above the temperature of the aqueous fibrous slurry, i.e., above about 20 degrees Centigrade. The material may be a hydrocarbon or a mixture of hydrocarbons, e.g., a paraffin wax, an ester or mixture of esters, e.g., beeswax, or a synthetic organic material, e.g., a polyether such as "carbowax". The material may be polymeric. Where the wax is a naturally occurring wax it may include esters of long chain monohydric alcohols, i.e., $C_{16}$ and above, with long fatty acids, i.e., $C_{16}$ and above, a hydrocarbon, or mixture of hydrocarbons. Additionally there may be present esters of dibasic acids, esters of hydroxy acids, esters of diols, long chain alcohols, and polymeric aldehydes.

Other coatings which may be useful include polyvinyl alcohols, lacquers and the like.

The adherent, protective, destructible material should be capable of forming a substantially continuous, protective, adherent film on the porous surface of the cathode, and capable of covering or covering and penetrating the pores. Moreover, it should be insoluble or sparingly soluble in the medium from which the diaphragm is deposited. That is, it should cover or cover and penetrate the pores of the cathode during diaphragm deposition. Moreover, the adherent, protective, destructible film should be removable, destructible, or decomposable under conditions which do not significantly adversely affect the subsequent performance of either the cathode or the diaphragm.

The protective film may be applied to the cathode in various ways. The cathode may be dipped or immersed in a liquid of the protective film material. The liquid may contain protective film material and a solvent, or molten protective film material, or monomeric or prepolymeric protective film material. Alternatively the protective film material may be drawn through the cathode, e.g., as a solution, slurry, or dispersion thereof, as a molten material, or as a monomer or pre-polymer thereof. According to a further alternative, the film of protective material may be sprayed, painted or brushd onto a cathode, e.g., as a solution, slurry, or dispersion thereof, as a molten material, or as a pre-polymer or monomer thereof. According to a still further exemplification, the film of protective material may be condensed onto the cathode, i.e., as a condensing gas or vapor.

When the film of protective material is applied as a monomer or prepolymer, or as a non-cross linked, cross linkable polymer, it may be cured by methods well known in the art to provide an adherent coating.

The material should be destructible after deposition and formation of the diaphragm, i.e., it should be removable, destructible, or decomposable under conditions which do not significantly adversely affect the subsequent performance of the cathode or the diaphragm. For example, it should be soluble in brine at the temperatures encountered in electrolysis, i.e., about 85 degrees Centigrade to 105 degrees Centigrade, or capable of pyrolysis, oxidation, or evaporation at the temperatures at which the diaphragm is cured, or at which the thermoplastic resin, if any, deposited with the diaphragm material, is fluid; or capable of removal with a solvent or reactant without damage to the cathode, catalytic coating, or diaphragm.

The adherent, destructible film is thick enough to substantially cover the cathode surface, and cover or cover and fill the pores of the cathode surface to thereby minimize adhesion of the diaphragm material to the cathode, and thin enough to avoid obstructing the perforations of the foraminous cathode. This is generally a thickness of from about 0.1 to about 20 mils.

The resulting film is an adherent, destructable film on the foraminous cathode. By "adherent" is meant that the film, for example, the waxy film, adheres to the cathode, only covering or covering and filling the pores, during at least the initial stages of diaphragm deposition and formation, while by "destructible" is meant that the film is substantially destroyed, i.e., to an extent not to interfere with product evolution, by either at least a short period of electrolysis or a subsequent step in diaphragm formation. Preferably the adherent destructible protective film is destructible by aqueous alkali metal hydroxide after a short period of exposure, or by heat at temperatures of curing or reinforcing the diaphragm, or by combustion or vaporization at temperatures of curing or reinforcing the diaphragm in the presence of air.

For example, where the diaphragm is an asbestos diaphragm, substantially free of organic materials, the destructible protective film may be destructible by aqueous alkali metal hydroxide after a short period of electrolysis or by heating in an oxidizing atmosphere to combustion or pyrolysis temperatures. Alternatively, where the slurry of diaphragm material includes organic materials, as thermoplastic resins, the destructible protective film may be destructible by evaporation, or combustion at temperatures where the thermoplastic resin or organic materials are fluid. Alternatively, the protective film may be destructible by solvent extraction or chemical reaction.

According to a still further alternative, where the diaphragm material is asbestos, either with or without organic materials therein, and where the asbestos is dried or thermally cured or both after deposition, for example as described in U.S. Pat. No. 3,991,251 to Foster et al, the adherent, destructible film may be destroyed either during the drying or during the thermal cure.

According to one exemplification of the method herein contemplated, a resin-reinforced asbestos diaphragm may be deposited atop a wax film on a catalytic cathode. The catalytic cathode may be an expanded iron mesh substrate having a porous nickel surface, as prepared by the codeposition of nickel and aluminum and the leaching of the aluminum. Thereafter, the porous nickel-coated cathode is immersed in molten wax, removed from the molten wax and the pores opened, e.g., by blowing a mild jet of air approximately perpendicularly to the surface of the wax coated cathode. Thereafter, an entangled, self-adherent mat may be deposited on the cathode by drawing a slurry of chrysotile asbestos and polymer through the wax coated cathode whereby to deposit the chrysotile asbestos and the polymer on the wax coated cathode. The cathode and diaphragm unit may then be heated, for example to about 250 to 300 degrees Centigrade, whereby to melt the polymer and to cause the asbestos fibers to adhere to each other. During the course of the polymer melting, the wax film may be combusted or evaporated.

The diaphragm of this invention, prepared according to the method of this invention, is a self-adherent, entangled fibrous mass of non-woven, unoriented fibers, conforming to, spaced from, non-adherent to, and removable from the cathode. The diaphragm material may be chrysotile asbestos, and may contain a reinforcing or stabilizing amount of a thermoplastic resin or resins. Alternatively, the diaphragm may be chrysotile asbestos to which a thermoplastic resin may have been added in order to enhance the thermal cure or properties thereof. Electrolysis may take place on the surface of the cathode facing the diaphragm and anode, with hydrogen evolved on the surface of the cathode facing the diaphragm and anode.

As herein contemplated, after a period of electrolysis, i.e., long enough for the diaphragm to display signs of wear, such as from about three months to about 18 months or more, the cathode-diaphragm unit can be taken out of service and the diaphragm removed therefrom, for example with mechanical stripping, low pressure water, or the like, with substantially little damage, if any, to the catalytic cathode. A new catalytic cathode coating need not be deposited atop the cathode substrate prior to depositing a new diaphragm, where the wax coating as described herein is utilized.

The following example illustrates the practice of the present invention:

EXAMPLE

A cathode having a porous nickel-molybdenum surface on a steel substrate was put through four cycles of application of a wax coating atop the nickel-molybdenum surface, deposition of a resin reinforced asbestos diaphragm atop the wax coating, use as a cathode, and removal of the diaphragm.

The cathode was prepared by degreasing and sand blasting a 6 by 6 mesh per inch, 5 inch by 7 inch, by 0.1 inch strand thick steel mesh. A precoat of METCO 447 nickel powder was plasma sprayed onto the mesh. Thereafter a powder of 80 weight percent, minus 325 mesh Davidson nickel-aluminum Raney alloy and 20 weight percent, 2 to 4 micron, Cerac molybdenum was plasma sprayed onto the mesh to provide a surface that contained nickel and molybdenum. The plasma sprayed mesh was then activated in 1 N aqueous sodium hydroxide at 24 degrees Centigrade for 14 hours.

In each diaphragm application cycle 850 milliliters of Fisher Scientific Company Tissue Preparation Wax was heated to 80 degrees Centigrade in a Pyrex® dish in a laboratory oven. The activated cathode was immersed in the molten wax for about 60 seconds, removed from the wax, and the wax gently blown out of the openings.

For each diaphragm deposition cycle an asbestos-resin slurry was prepared. The slurry contained 22.7 grams per liter of 3T-CT chrysotile asbestos, 2.6 grams per liter of Allied Chemical Corporation Halar® poly(chlorotrifluoroethylene-ethylene) polymer, and 2.3 grams per liter of DuPont Zonyl® surfactant. The slurry had a density of 1.222 grams per milliliter.

In each cycle the cathode was placed in a frame to which a vacuum can be applied, and the slurry was poured onto the wax coated cathode and drawn through the cathode by the application of a vacuum. The following vacuum cycle was utilized:

| Time (Minutes) | Cumulative Time (Minutes) | Vacuum (Millimeters of Mercury) |
|---|---|---|
| 3 | 3 | 0 mm |
| 4 | 7 | 50 mm |
| 4 | 11 | 100 mm |

-continued

| Time (Minutes) | Cumulative Time (Minutes) | Vacuum (Millimeters of Mercury) |
|---|---|---|
| 4 | 15 | 200 mm |
| 4 | 19 | 400 mm |
| 20 | 39 | 550 mm |

Thereafter, the cathode-diaphragm assembly was heated at the rate of 10 degrees Centigrade per ten minutes to 150 degrees Centigrade, and then to 285 degrees Centigrade. The cathode-diaphragm assembly was then cooled and installed in a laboratory diaphragm cell.

The laboratory diaphragm cell had a ruthenium dioxide-titanium dioxide coated titanium mesh anode spaced 6 millimeters from the cathode-diaphragm assembly. The feed to the cell was 25 weight percent aqueous sodium chloride, and electrolysis was carried out at a current density of 200 amperes per square foot.

At intervals of 7 to 96 days, electrolysis was discontinued, the cell was disassembled, the diaphragm was manually stripped from the cathode, and a new diaphragm was deposited on the cathode atop a fresh wax deposit, as described above.

The following results were obtained:

| Duration of Run (days) | Cumulative Electrolysis (days) | Hydrogen Evolution Overvoltage Range (volts) |
|---|---|---|
| 16 | 16 | 0 to 0.004 |
| 30 | 46 | 0.003 to 0.020 |
| 7 | 53 | 0.007 |
| 96 | 149 | 0.002 to 0.003 |

The series of tests indicated no trend of increasing cathodic hydrogen evolution overvoltage with cumulative electrolysis or with diaphragm removal cycles.

While the invention has been described with respect to certain exemplifications and embodiments thereof, the scope thereof is not to be so limited except as in the claims appended hereto.

We claim:

1. In a method of preparing a cathode-diaphragm assembly comprising drawing a slurry of diaphragm material through a foraminous cathode whereby to deposit the diaphragm material on the foraminous cathode, the improvement comprising first depositing an adherent, destructible film on the foraminous cathode, said adherent, destructible film chosen from the group consisting of waxes, polyvinyl alcohol and lacquers, and thereafter depositing the fibrous diaphragm material thereon.

2. The method of claim 1 wherein the adherent, destructible film is destructible by aqueous alkali metal hydroxide.

3. The method of claim 1 wherein the slurry of diaphragm material further includes thermoplastic resin, and wherein the adherent, destructible film is destructible at temperatures where the thermoplastic resin is fluid.

4. The method of claim 1 wherein the slurry of diaphragm material further includes thermoplastic resin, and wherein the adherent, destructible film is destructible below temperatures where the thermoplastic resin is fluid.

5. The method of claim 1 wherein the diaphragm material is asbestos, wherein the asbestos is dried and thermally cured after deposition, and wherein the adherent, destructible film is destructible during drying and cure of the asbestos.

6. The method of claim 1 wherein the diaphragm material is asbestos, and wherein the asbestos is dried and thermally cured after deposition, and wherein the adherent, destructible film is destructible prior to drying and cure of the asbestos.

7. The method of claim 1 wherein the adherent, destructible film is thick enough to avoid substantial adhesion of the diaphragm material to the cathode, and thin enough to avoid substantial blockage of the foraminous cathode.

8. The method of claim 1 wherein the foraminous cathode comprises a foraminous, metal substrate with an electrocatalytic coating thereon.

9. The method of claim 8 wherein the electrocatalytic coating is porous.

10. The method of claim 9 wherein the electrocatalytic coating is of a different material than the substrate.

11. The method of claim 10 wherein the foraminous substrate is ferrous, and the porous, electrocatalytic coating comprises nickel.

12. The method of claim 1 wherein the adherent, destructible material has a melting point above the temperature of the diaphragm material slurry.

13. The method of claim 1 wherein the adherent, destructible film is substantially insoluble in the diaphragm material slurry.

14. An electrolytic cell comprising an anode, a foraminous cathode, and a permeable diaphragm therebetween, said diaphragm comprising a self-adherent, entangled web of slurry deposited diaphragm material, and prepared by the method comprising depositing an adherent, destructible, protective film on the foraminous cathode, said film chosen from the group consisting of waxes, polyvinyl alcohol, and lacquer, and thereafter depositing the fibrous diaphragm material atop the adherent, destructible, protective film.

15. The electrolytic cell of claim 4 wherein the adherent, destructible film is destructible by aqueous alkali metal hydroxide.

16. The electrolytic cell of claim 14 wherein the slurry of diaphragm material further includes thermoplastic resin, and wherein the adherent, destructible film is destructible at temperatures where the thermoplastic resin is fluid.

17. The electrolytic cell of claim 14 wherein the slurry of diaphragm material further includes thermoplastic resin, and wherein the adherent, destructible film is destructible below temperatures where the thermoplastic resin is fluid.

18. The electrolytic cell of claim 14 wherein the diaphragm material is asbestos, wherein the asbestos is dried and thermally cured after deposition, and wherein the adherent, destructible film is destructible during drying and cure of the asbestos.

19. The electrolytic cell of claim 14 wherein the diaphragm material is asbestos, and wherein the asbestos is dried and thermally cured after deposition, and wherein the adherent, destructible film is destructible prior to drying and cure of the asbestos.

20. The electrolytic cell of claim 14 wherein the adherent, destructible film is thick enough to avoid substantial adhesion of the diaphragm material to the cathode, and thin enough to avoid substantial blockage of the foraminous cathode.

21. The electrolytic cell of claim 14 wherein the foraminous cathode comprises a foraminous, metal substrate with an electrolytic coating thereon.

22. The electrolytic cell of claim 21 wherein the electrocatalytic coating is porous.

23. The electrolytic cell of claim 22 wherein the electrocatalytic coating is of a different material than the substrate.

24. The electrolytic cell of claim 23 wherein the foraminous substrate is ferrous, and the porous, electrocatalytic coating comprises nickel.

25. The electrolytic cell of claim 15 wherein the adherent, destructible material has a melting point above the temperature of the diaphragm material slurry.

26. The electrolytic cell of claim 15 wherein the adherent, destructible film is substantially insoluble in the diaphragm material slurry.

27. In a method of preparing a cathode-diaphragm assembly comprising drawing a slurry of diaphragm material comprising asbestos fibers and thermoplastic resin through a foraminous cathode whereby to deposit the diaphragm material on the foraminous cathode, and thereafter heating the cathode-diaphragm assembly to render the thermoplastic resin fluid, the improvement comprising first depositing an adherent, destructible film on the foraminous cathode, said destructible film being thermally destructible at temperatures where the thermoplastic resin is fluid, and thereafter depositing the diaphragm material thereon.

28. In a method of preparing a cathode-diaphragm assembly comprising drawing a slurry of fibrous asbestos diaphragm material through a foraminous cathode whereby to deposit the diaphragm material on the foraminous cathode and thereafter heating the diaphragm-cathode assembly to dry and thermally cure the fibrous asbestos diaphragm material, the improvement comprising flat depositing an adherent, destructible film on the foraminous cathode, said destructible film being destructible during drying and cure of the asbestos.

29. An electrolytic cell comprising an anode, a foraminous cathode, and a permeable diaphragm therebetween, said diaphragm comprising a self-adherent, entangled web of slurry deposited asbestos fibers and thermoplastic resin, said diaphragm prepared by the method comprising first depositing an adherent, destructible film on the foraminous cathode, said adherent, destructible film being thermally destructible at temperatures where the thermoplastic resin is fluid, and thereafter depositing the asbestos fibers and thermoplastic resin thereon.

30. An electrolytic cell comprising an anode, a foraminous cathode, and a permeable diaphragm therebetween, said diaphragm comprising a self-adherent, entangled web of slurry deposited, thermally cured asbestos fibers, said diaphragm prepared by the method comprising first depositing an adherent, destructible film on the foraminous cathode, said adherent, destructible film being thermally destructible at temperatures where the asbestos fibers are thermally cured.

31. A cathode-diaphragm unit comprising:

(a) a cathode having a foraminous metal substrate with a porous catalytic surface thereon; and (b) a diaphragm comprising a slurry deposited, self-adherent, entangled, fibrous asbestos mat, conforming to and supported by the cathode, and substantially non-adherent to the porous catalytic surface thereof after commencement of electrolysis; said diaphragm prepared by the method comprising depositing an adherent, destructible, protective film on the foraminous cathode, and thereafter depositing fibrous asbestos atop the adherent, destructible, protective film.

32. The cathode-diaphragm unit of claim 31 wherein irregular point contact exists between the diaphragm and the porous catalytic surface.

33. The cathode-diaphragm unit of claim 30 wherein contact-free channels 2 to 5 mils in diameter exist between the diaphragm and the porous, catalytic surface.

34. The cathode-diaphragm unit of claim 31 wherein the adherent, destructible film is destructible by aqueous alkali metal hydroxide.

35. The cathode-diaphragm unit of claim 31 wherein the slurry of asbestos further includes thermoplastic resin, and wherein the adherent, destructible film is destructible at temperatures where the thermoplastic resin is fluid.

36. The cathode-diaphragm unit of claim 31 wherein the slurry of asbestos further includes thermoplastic resin, and wherein the adherent, destructible film is destructible below temperatures where the thermoplastic resin is fluid.

37. The cathode-diaphragm unit of claim 31 wherein the asbestos is dried and thermally cured after deposition, and wherein the adherent, destructible film is destructible during drying and cure of the asbestos.

38. The cathode-diaphragm unit of claim 31 wherein the asbestos is dried and thermally cured after deposition, and wherein the adherent, destructible film is destructible prior to drying and cure of the asbestos.

39. The cathode-diaphragm unit of claim 31 wherein the adherent, destructible film is thick enough to avoid substantial adhesion of the asbestos diaphragm material to the cathode, and thin enough to avoid substantial blockage of the foraminous cathode.

40. The cathode-diaphragm unit of claim 31 wherein the adherent, destructible coating is chosen from the group consisting of waxes, polyvinyl alcohol, and lacquers.

41. The cathode-diaphragm unit of claim 31 wherein the adherent, destructible material has a melting point above the temperature of the asbestos slurry.

42. The cathode-diaphragm unit of claim 31 wherein the adherent, destructible film is substantially insoluble in the asbestos slurry.

* * * * *

UNITED STATES PATENT AND TRADEMARK OFFICE

CERTIFICATE OF CORRECTION

PATENT NO. : 4,366,041

DATED : December 28, 1982

INVENTOR(S) : Malcolm Korach and Ronald D. Chamberlin

It is certified that error appears in the above-identified patent and that said Letters Patent is hereby corrected as shown below:

In Claim 28, line 37, "flat" should read --first--.

Signed and Sealed this

*Tenth* Day of *May 1983*

[SEAL]

*Attest:*

GERALD J. MOSSINGHOFF

*Attesting Officer*

*Commissioner of Patents and Trademarks*